US006491025B2

(12) United States Patent
Ferry et al.

(10) Patent No.: US 6,491,025 B2
(45) Date of Patent: Dec. 10, 2002

(54) CONTROLLED NOZZLE INJECTION METHOD AND APPARATUS

(75) Inventors: William R. Ferry, Feeding Hills, MA (US); James R. Voss, Dupont, IN (US); Martin G. Riccitelli, Montgomery, MA (US)

(73) Assignee: Governors America Corp., Agawam, MA (US)

( * ) Notice: Subject to any disclaimer, the term of this patent is extended or adjusted under 35 U.S.C. 154(b) by 0 days.

(21) Appl. No.: 09/737,163

(22) Filed: Dec. 14, 2000

(65) Prior Publication Data

US 2001/0029925 A1 Oct. 18, 2001

Related U.S. Application Data

(60) Provisional application No. 60/170,697, filed on Dec. 14, 1999.

(51) Int. Cl.[7] ..... F02M 41/00
(52) U.S. Cl. ..... 123/456; 123/447
(58) Field of Search ..... 123/456, 447, 123/457, 458, 459, 463, 511

(56) References Cited

U.S. PATENT DOCUMENTS 5,176,120 A 1/1993 Takahashi
5,201,295 A 4/1993 Kimberley et al.
5,218,942 A * 6/1993 Coha et al. ..... 123/514
5,337,718 A * 8/1994 Tuckey ..... 123/464
5,526,792 A * 6/1996 Guth et al. ..... 123/467
5,832,900 A 11/1998 Lorraine
6,142,127 A * 11/2000 Maass ..... 123/514

* cited by examiner

*Primary Examiner*—Willis R. Wolfe
*Assistant Examiner*—Mahmoud Gimie
(74) *Attorney, Agent, or Firm*—McCormick, Paulding & Huber LLP

(57) ABSTRACT

A nozzle injection apparatus for use in internal combustion engines includes a fuel pump for intermittently pressurizing fuel and an injection conduit in fluid communication with the fuel pump, the injection conduit permitting the pressurized fuel to be communicated to a fuel injection nozzle. A high pressure manifold in fluid communication with the fuel pump and the nozzle is also provided to accumulate the pressurized fuel which is residually left in the injection conduit between intermittent pressurizations of the fuel. The apparatus has low opening and closing pressures when starting the engine while ensuing high opening and closing pressures during operation of the engine. Further, the apparatus maintains high residual pressure in the injection conduit which provides higher than normal pressure to the nozzle at the end of a fuel delivery cycle to subsequently reduce exhausted pollutants.

16 Claims, 3 Drawing Sheets

CONTROLLED NOZZLE INJECTION METHOD AND APPARATUS

CROSS REFERENCE TO RELATED APPLICATIONS

This application claims the benefit of pending U.S. Provisional Application No. 60/170,697, filed Dec. 14,1999.

FIELD OF THE INVENTION

This invention relates in general to a controlled nozzle injection method and apparatus, and deals more particularly with a controlled nozzle injection method and apparatus which operates to reduce the amount of polluting contaminants emitted by an internal combustion engine.

BACKGROUND OF THE INVENTION

Internal combustion engines are well known power generating devices which may have any number of differing configurations in dependence upon the type of fuel utilized, their size and the particular environment in which they are designed to operate.

Although several electronic fuel delivery systems for internal combustion vehicles are known to provide adequate performance characteristics, these systems tend to be expensive and do not address those motorized vehicles which include non-electronic fuel delivery systems. In those systems which utilize standard mechanical pumps for this purpose, there exists several inherent inefficiencies which the present invention seeks to address.

As can be seen in FIG. 1, a known fuel delivery system 10 of a typical high pressure, diesel engine utilizes a mechanical pump 12 (also referred to as a jerk pump or a block pump), and an unillustrated arrangement of camshafts and plungers, to intermittently provide a predetermined amount of fuel from a fuel supply 14 to a fuel injector 16. The fuel injector 16 operates to atomize the fuel and directs the resultant fuel charge to the combustion chamber 18 of a vehicle via a fuel line 20, thus completing one fuel delivery cycle.

In operation, pressure within the fuel injector 16 continues to build as the pump 12 provides fuel to the fuel injector 16 at the onset of a given fuel delivery cycle. A spring biased injector valve 22, typically a needle valve or the like of the fuel injector 16, opens in response to the pressure building within the fuel injector 16, thereby causing fuel to be dispensed through a series of passageways and into the vehicle's combustion chamber.

FIG. 2 is a graph illustrating the pressure at the nozzle portion of the fuel injector 16 during the fuel delivery cycle, wherein a slight drop in pressure can be seen to occur at the start of the injection process, although pressure continues to build at a desired rate after fuel injection has begun. Fuel will therefore continue to be delivered to the combustion chamber of the vehicle until the pressure within the fuel injector falls below the return spring biasing force of the injector valve 22. In these known systems, residual fuel which is left in the nozzle portion of the fuel injector 16 after the injector valve 22 closes is typically vented from the nozzle portion via a nozzle leak off valve, conduit or the like.

In such systems as described in conjunction with FIGS. 1 and 2 above, the pressure of the fuel has a direct effect on how the fuel atomizes within the fuel injector 16, and hence on how the fuel burns within the combustion chamber of the vehicle. Larger droplets of fuel are provided to the combustion chamber of the vehicle during those times when the pressure at the nozzle potion of the fuel injector 16 is comparatively low. These larger droplets tend to take longer to evaporate, mix and burn and therefore may not be able to completely combust within the combustion chamber before being exhausted therefrom. Such incomplete combustion aggravates pollution concerns, including the production of increased particulates, smoke, odor, hydrocarbons, carbon monoxide and the like.

It would therefore be advantageous to modify existing fuel delivery systems so as to reduce the generation of pollutants while increasing the efficiency of the fuel delivery system as a whole. Towards this end, the present invention seeks to raise the closing pressure of the injected fuel, while holding the starting pressure of the fuel injection at an elevated level.

It has been determined that by raising the closing pressure, the needle valve in the nozzles starts to close earlier as the pressure in the injection line begins to drop. The nozzle therefore tends to close completely before the line pressure goes to zero, thereby reducing the quantity of fuel injected at an undesirably low pressure. A problem exists in incorporating this pressure architecture with standard mechanical, or jerk, pumps because known mechanical pumps cannot reach the desired high opening and closing pressures to start at typical cranking speeds.

With the forgoing problems and concerns in mind, the present invention seeks to provide a controlled nozzle injection method and apparatus which operates in conjunction with known mechanical fuel pumps to reduce the amount of polluting contaminants emitted by an internal combustion engine.

SUMMARY OF THE INVENTION

It is an object of the present invention to provide a controlled nozzle injection device.

It is another object of the present invention to provide a controlled nozzle injection device which operates to reduce the amount of polluting contaminants emitted by an internal combustion engine.

It is another object of the present invention to provide a controlled nozzle injection device which elevates the pressure at the beginning of the fuel delivery cycle.

It is another object of the present invention to provide a controlled nozzle injection device which maintains higher pressures at the end of the fuel delivery cycle.

According to one embodiment of the present invention, a nozzle injection apparatus for use in internal combustion engines includes a fuel pump for intermittently pressurizing fuel and an injection conduit in fluid communication with the fuel pump, the injection conduit permitting the pressurized fuel to be communicated to a fuel injection nozzle. A high pressure manifold in fluid communication with the fuel pump and the nozzle is also provided to accumulate the pressurized fuel which is residually left in the injection conduit between intermittent pressurizations of the fuel.

These and other objectives of the present invention, and their preferred embodiments, shall become clear by consideration of the specification, claims and drawings taken as a whole.

DETAILED DESCRIPTION OF THE PREFERRED EMBODIMENT

Figure 3:
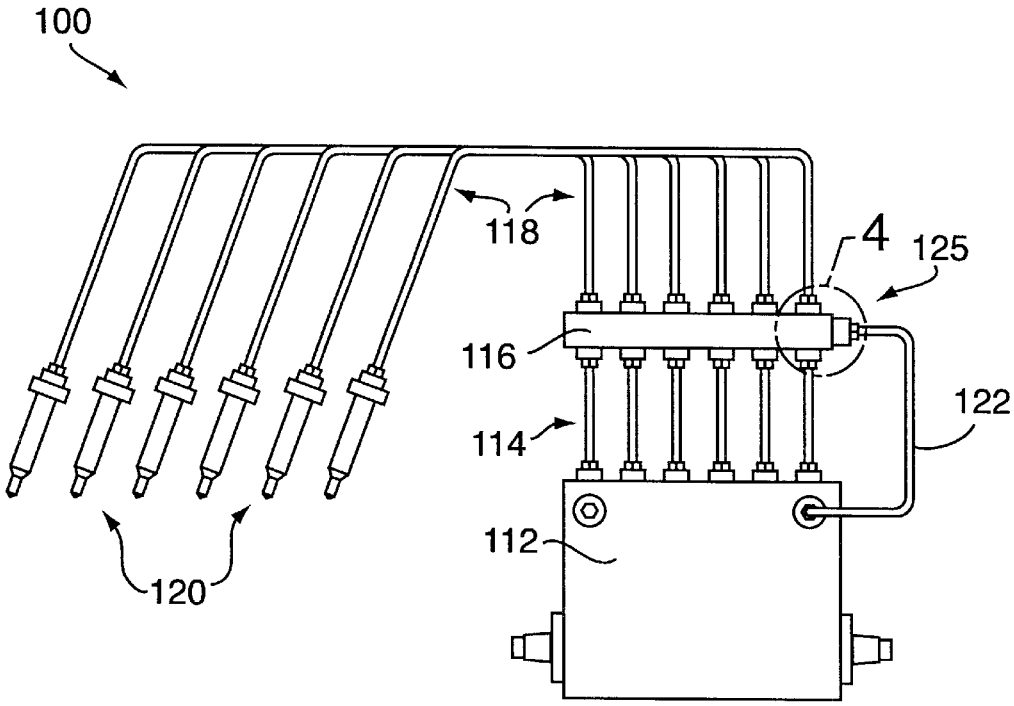
FIG. 3 illustrates a controlled nozzle injection apparatus according to one embodiment of the present invention.

FIG. 3 illustrates a controlled nozzle injection apparatus 100 according to one embodiment of the present invention. As illustrated in FIG. 3, a fuel injection pump 112 is provided to intermittently supply the injection apparatus 100 with a pressurized stream of fuel, typically a hydocarbon fuel comprising gasoline, diesel fuel or the like. The pump 112 operates to send streams of pressurized fuel through, in succession, a plurality of fuel transport conduits 114, a high pressure manifold 116, a plurality of fuel injection conduits 118 and, finally, to a plurality of fuel injector nozzles 120 which exhaust the fuel streams into an unillustrated combustion chamber of a vehicle. A fuel return conduit 122 is also provided for depressurizing the high pressure manifold 116, as will be described in more detail later.

Each of the nozzles 120 typically include a known arrangement of needle valves or the like which, when subjected to a threshold pressure, will permit passage of the pressurized fuel into the combustion chamber. The nozzles 120 do not, however, include leak off valves, conduits or the like which are typically provided to known nozzle assemblies to evacuate residual fuel therefrom like (as discussed previously). The present embodiment utilizes such leakless nozzles in order to trap residual, pressurized fuel within the spring chamber of the needle valves for subsequent use, as will be described in more detail later. Moreover, although there are a discreet number of conduits and fuel injector nozzles shown in FIG. 3, it will be readily appreciated that the present invention contemplates the incorporation of any number of conduits or nozzles without departing from the broader aspects of the present invention.

Figure 4:
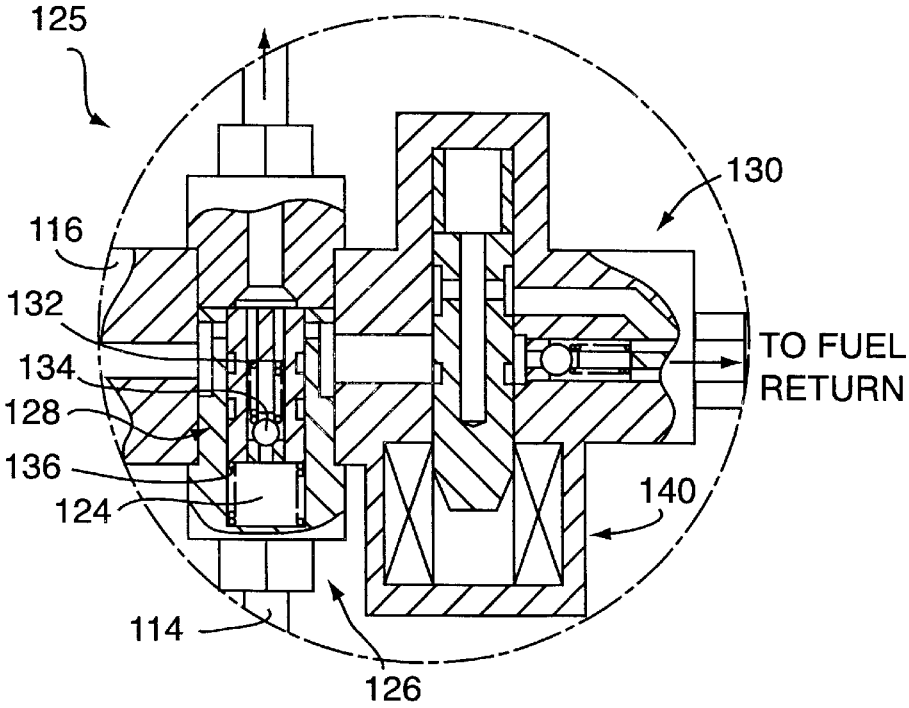
FIG. 4 is an enlarged, partial cross-sectional view of a valve assembly utilized in the injection apparatus of FIG. 3.

Returning to FIG. 3, the high pressure manifold 116 is provided with a plurality of differing valve sets 125 which are utilized to control the flow and pressure of the fuel streams provided by the fuel pump 112. FIG. 4 is an enlarged, partial cross-sectional view of the valve sets 125 utilized to control the flow and pressure of the fuel streams in accordance with the present invention.

As shown in FIG. 4, a check valve assembly 126 works in concert with a spool valve assembly 128 and a pressure relief valve assembly 130 to bootstrap residual pressure left in the injection apparatus 100 at the conclusion of each fuel cycle back into the injection apparatus 100. By doing so, the present invention seeks to maintain high fuel injection pressures at the end of the fuel delivery cycle, similar to the high injection pressures present at the beginning of the fuel delivery cycle.

Operation of the injection apparatus 100 will now be described in conjunction with FIGS. 3 and 4. At the beginning of an initial fuel delivery cycle, the fuel pump 112 pressurizes a predetermined amount of fuel from an unillustrated fuel supply. As best seen in FIG. 4, the pressurized fuel travels through the transport conduit 114 and pools in a spring chamber 124 of a check valve assembly 126. Once the pressure within the spring chamber 124 overcomes the reverse biasing force of a check spring 132, a check ball valve 134 will be displaced, thereby allowing the pressurized stream of fuel to pass through the injection conduit 118 on the way to the nozzles 120 where a needle valve, or the like, opens and releases an atomized fuel stream into the combustion chamber of a motorized vehicle.

As pressure within the spring chamber 124 lessens at the end of the initial fuel delivery cycle, the check ball valve 134 will reassume its blocking position leaving a measured amount of residual fuel, and therefore pressure, trapped in the injection conduits 118. While known systems remove this residual pressure, the present invention redirects the remaining pressurized fuel to the high pressure manifold 116 for later use. Returning to FIG. 4, the residual pressurized fuel in the injection conduits 118 forces the spool valve assembly 128 to shift against the biasing force of a return spring 136 housed within the spring chamber 124. A passageway is thereby created which allows the pressurized fuel to be redirected to the high pressure manifold 116 for later use, the spool valve assembly 128 subsequently reassuming its original position. At this point, the needle valves of the nozzles 120 are also exposed to the residual fuel pressure in the injection conduits 118 and, therefore, a small amount of pressurized fuel will leak into an unillustrated spring chamber of the nozzles 120, and so the opening and closing pressures of the nozzles 120 will be somewhat higher for subsequent fuel deliver cycles.

As subsequent fuel delivery cycles are performed, the residual pressurized fuel will continue to be 'boot-strapped' into the high pressure manifold 116, as described above, until the injection conduits 118 and the high pressure manifold 116 have reached and stabilized at a predetermined elevated pressure. In one particular design embodiment, the pressure of the injection lines 118 and the high pressure manifold 116 are designed to stabilize at approximately 4000 psi, whereby detrimentally higher pressures are guarded against through the action of the pressure relief valve assembly 130 which shunts excessive pressure back to the fuel pump 112 for later use via the fuel return line 122.

Figure 5:
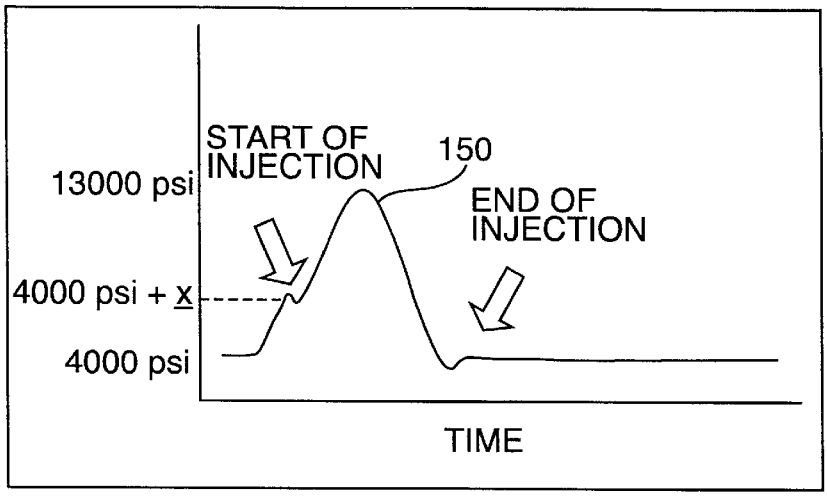
FIG. 5 is a graph illustrating the pressure at the nozzle portion of a fuel injector during the fuel delivery cycle according to the nozzle injection apparatus of FIG. 3.

As will now be appreciated, once a state has been reached in which the injection conduits 118 and the fuel manifold 116 have stabilized at a predetermined elevated pressure, each subsequent fuel delivery cycle will begin and end at a scaled pressure which is substantially higher than normal and higher than the predetermined elevated pressure. A graph illustrating the forgoing pressure architecture during operation of the injection apparatus 100 is shown in FIG. 5. As can be seen from FIG. 5, subsequent to the pressure within the injection conduits 118 and the fuel manifold 116 having stabilized, the pressure curve 150 has similar characteristics to the pressure curve of known fuel delivery systems, as illustrated previously in FIG. 2. In the present invention, however, FIG. 5 illustrates how the pressure of the injected fuel remains high even during the later stages of each fuel delivery cycle, owing to the elevated pressure maintained in the high pressure manifold 116 and the injection conduits 118 as a result of the bootstrapping of pressurized fuel.

Figure 2:
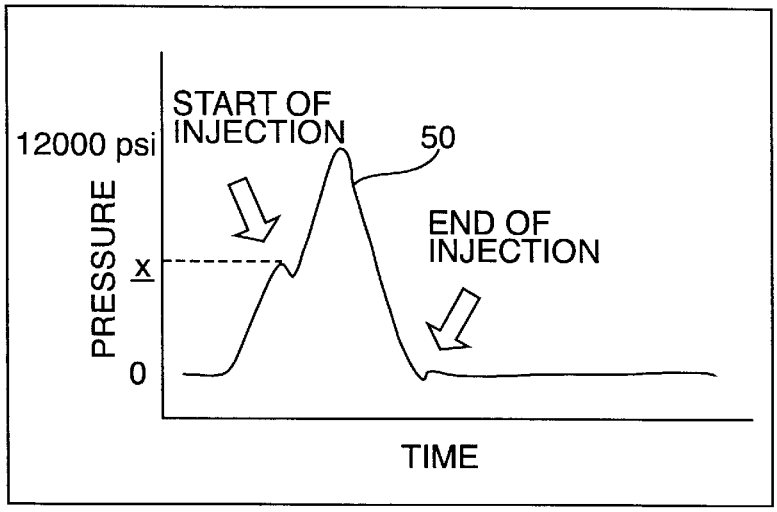
FIG. 2 PRIOR ART
FIG. 2 is a graph illustrating the pressure at the nozzle portion of a fuel injector during the fuel delivery cycle according to the fuel delivery system of FIG. 1.

In particular, when comparing the pressure curve 50 of FIG. 2 to the pressure curve 150 of FIG. 5, it will be apparent that the pressure at the nozzle at the onset of fuel injection may be represented by X that is, the dynamic pressure provided by the fuel pump which is sufficient to open the needle valve of the nozzle. In FIG. 5, owing to the boot-strapping of pressure and the use of leakless nozzles 120 (as described previously), the pressure at the nozzles 120 is represented by the residual pressure in the system, 4000 psi in FIG. 5, plus the dynamic pressure X provided by the fuel pump 112. In this manner, the present invention ensures that high opening and closing pressures may be maintained at the nozzles 120 during operation of the vehicle, resulting in a more complete combustion of injected fuel and a corresponding reduction in the pollutants exhausted therefrom.

It is therefore an important aspect of the present invention that the fuel streams provided to the combustion chamber of a motorized vehicle are maintained at an elevated pressure, especially at the nozzles 120, thereby ensuring a more complete combustion of these fuel streams and an associated reduction in exhausted polluting contaminants.

It is another aspect of the present invention that the injection apparatus 100 illustrated in FIGS. 3 and 4 may be incorporated onto existing motorized vehicles without incurring significant expenses. In order to accommodate the present invention into existing fuel delivery systems, an electrically actuated valve 140, typically a solenoid or the like, is provided to the pressure relief valve assembly 130. The solenoid valve 140 is actuated to vacate pressure within the high pressure manifold 116 during the initial cranking of the motorized vehicle's engine, to be in conformance with the motorized vehicle's original pressure design parameters. Once the vehicle has started, the solenoid valve would again be actuated to enable the fuel delivery routine as described above. While the primary function of the solenoid valve 140 is to reduce the build-up of pressure during a starting operation, the present invention also contemplates actuating the solenoid valve 140 in order to lower the opening and closing pressures of the nozzles 120 during low idle to reduce idling noise and the like.

Moreover, it should be noted that any additional expense incurred as a result of the incorporation of the more intricate valve assemblies of the present invention, as shown in FIG. 4, may be substantially offset by a reduction in other fuel delivery system components. In particular, as no 'leak-off' capability must be directly attributed to the nozzles 120, as is standard in known fuel delivery systems, there is no need to drill leak-off holes in the nozzles 120 and the associated tubing and hoses for such are correspondingly eliminated. The present invention is therefore less expensive to produce and install than existing systems, as well as being more efficient.

In certain circumstances, it may be necessary to adjust the tubing or conduit sizes, as well as the size of the nozzles 120 themselves, in order to make the injection apparatus 100 work as designed at all engine operating speeds and for all fuel delivery demands, and the present invention contemplates such modifications without departing from the broader aspects of the present invention. In particular, the present invention may require that the injection conduits have as much as a 40% larger diameter than is typically present in those systems which utilize hydraulic mechanical fuel pumps. This may be required to ensure that the total pressure at the fuel pump does not get too high. In operation, the pressure at the pump end of the injection conduits is approximately equal to the residual pressure within the conduits plus the dynamic pressure required to propagate the fuel wave down the conduits. The dynamic pressure therefore needs to be reduced, and since the dynamic pressure is approximately inversely proportional to the injection conduits' internal area, the internal area of the injection conduits may need to be made larger, as mentioned above.

It is therefore another important aspect of the present invention that by increasing the internal area of the injection conduits, enhanced performance may be readily obtained at the nozzle end of the injection conduits as well. In practice, the pressure available to inject the pressurized fuel into the combustion chamber is again the sum of the residual pressure within the injection conduits and the dynamic pressures. A larger internal area of the injection conduits will therefore allow more pressurized fuel to be available to maintain pressure on the nozzle as the needle closes the nozzle at the end of a fuel delivery cycle. Larger injection conduits also reduce the frictional losses associated with the system.

Figure 6:
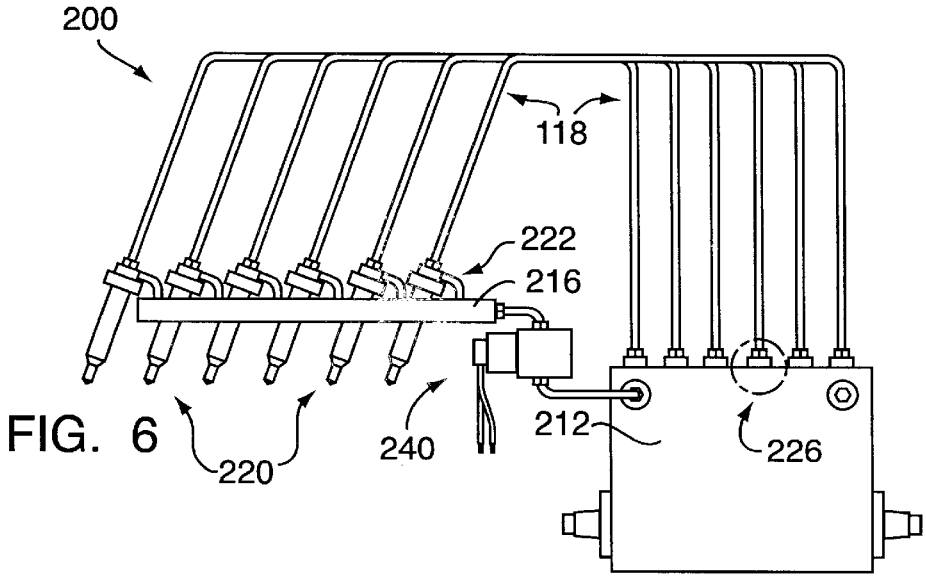
FIG. 6 illustrates a controlled nozzle injection apparatus according to another embodiment of the present invention.

FIG. 6 illustrates a controlled hydraulic nozzle injection apparatus 200 according to another embodiment of the present invention. As illustrated in FIG. 6, a fuel injection pump 212 is provided to intermittently supply the injection apparatus 200 with a pressurized stream of fuel, typically a hydocarbon fuel comprising gasoline, diesel fuel or the like. The pump 212 operates to send streams of pressurized fuel through, in succession, a plurality of dual valve assemblies 226, a plurality of fuel injection conduits 218 and, finally, to a plurality of fuel injector nozzles 220 which exhaust the fuel streams into an unillustrated combustion chamber of a vehicle.

Each of the nozzles 220 typically include a known arrangement of needle valves or the like which, when subjected to a threshold pressure, will permit passage of the pressurized fuel into the combustion chamber. Moreover, although there are a discreet number of conduits and fuel injector nozzles shown in FIG. 6, it will be readily appreciated that the present invention contemplates the incorporation of any number of conduits or nozzles without departing from the broader aspects of the present invention.

Returning to FIG. 6, a high pressure manifold 216 is provided and is connected to each of the leak-off conduits 222 of the nozzles 220 in order to assist in boot-strapping residual pressurized fuel, as will be described in more detail later. The high pressure manifold 216 is further connected to the fuel pump 212 via an electrically actuated valve, typically a solenoid or the like, and serves to vacate pressurized fuel from the high pressure manifold 216, back to the fuel pump 212, when necessary.

Figure 7:
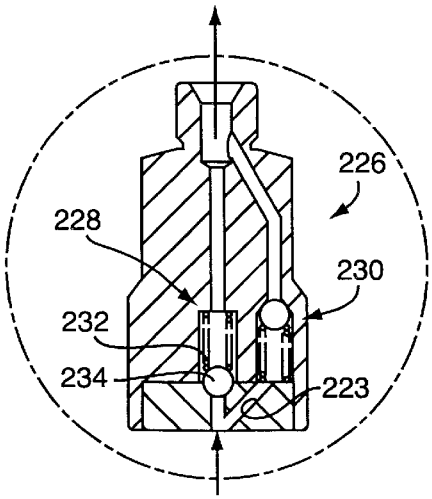
FIG. 7 is an enlarged, partial cross-sectional view of a dual valve assembly utilized in the injection apparatus of FIG. 6.

As more clearly illustrated in FIG. 7, the dual valve assembly 226 includes a check valve assembly 228 and a pressure relief valve assembly 230 which bootstraps residual pressure left in the injection apparatus 200 at the conclusion of each fuel cycle back into the injection apparatus 200. By doing so, the present invention seeks to maintain high fuel injection pressures at the end of the fuel delivery cycle, similar to the high injection pressures present at the beginning of the fuel delivery cycle.

Operation of the injection apparatus 200 will now be described in conjunction with FIGS. 6 and 7. At the beginning of an initial fuel delivery cycle, the fuel pump 212 pressurizes a predetermined amount of fuel from an unillustrated fuel supply. As best seen in FIG. 7, once the pressurized fuel overcomes the biasing force of a check spring 232, a check ball valve 234 will be displaced, thereby allowing the pressurized stream of fuel to pass through the injection conduits 218 on the way to the nozzles 220 where a needle valve, or the like, opens and releases an atomized fuel stream into the combustion chamber of a motorized vehicle.

At the end of the initial fuel delivery cycle, the check ball valve 234 will reassume its blocking position leaving a measured amount of residual fuel, and therefore pressure, trapped in the injection conduits 218. While known systems remove this residual pressure, typically by the retraction volume in the delivery valves, the present invention arrests the remaining pressurized fuel by virtue of the pressure relief valve assembly 230. Owing to this trapped, residual pressurized fuel in the injection conduits 218, a small amount of the pressurized fuel will be shunted through the leak-off conduits 222 and into the high pressure manifold 216 for later use. The leakage of pressurized fuel into the high pressure manifold 216 affects subsequent movement of the needle valve in the nozzles 220, and so the opening and closing pressures of the nozzles 220 will be somewhat higher for subsequent fuel deliver cycles.

As subsequent fuel delivery cycles are performed, the residual pressurized fuel will continue to be 'boot-strapped' into the high pressure manifold 216, as described above, until the injection conduits 218 and the high pressure manifold 216 have reached and stabilized at a predetermined elevated pressure. In one particular design embodiment, the pressure of the injection lines 218 and the high pressure manifold 216 stabilize at approximately 4000 psi, whereby detrimentally higher pressures are guarded against through the action of the pressure relief valve assembly 230 which shunts excessive pressure back to the fuel pump 212 for later use via a fuel return path 223.

Figure 1:
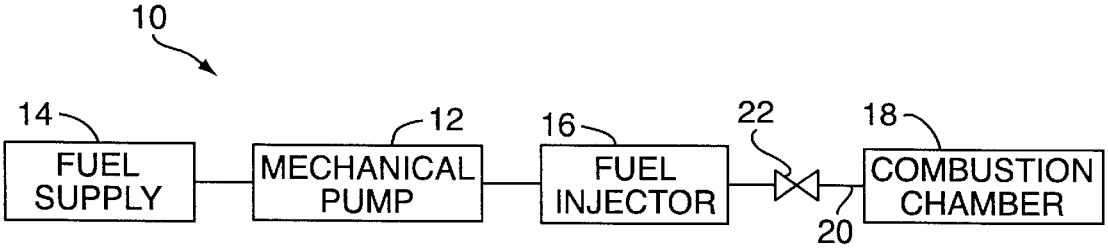
FIG. 1 PRIOR ART
FIG. 1 is a block diagram of a known fuel delivery system for internal combustion engines.

As will now be appreciated, once a state has been reached in which the injection conduits 218 and the fuel manifold 216 have stabilized at a predetermined elevated pressure (approximately 4000 psi, in the example above), each subsequent fuel delivery cycle will begin and end at a scaled pressure which is substantially higher than normal and higher than the predetermined elevated pressure. A graph illustrating the forgoing pressure architecture during operation of the injection apparatus 200 can be seen in previously discussed FIG. 5. As can be seen from FIG. 5, although the pressure curve 150 has similar characteristics to the pressure curve 50 of known fuel delivery systems as illustrated previously in FIGS. 1 and 2, the pressure of the injected fuel remains high even during the later stages of each fuel delivery cycle, owing to the elevated pressure maintained in the high pressure manifold 216 and the injection conduits 218 as a result of the bootstrapping of pressurized fuel.

Similar to the operation of the injection apparatus 100 of FIGS. 3 and 4, the injection apparatus 200 ensures that the fuel streams provided to the combustion chamber of a motorized vehicle are maintained at an elevated pressure, especially at the nozzles 220, thereby ensuring a more complete combustion of these fuel streams and an associated reduction in exhausted polluting contaminants.

Moreover, the injection apparatus 200 illustrated in FIGS. 6 and 7 may be incorporated onto existing motorized vehicles without incurring significant expenses. In order to accommodate the injection apparatus 200 into existing fuel delivery systems, an electrically actuated valve 240, typically a solenoid or the like, is provided between the high pressure manifold 216 and the fuel pump 212. The solenoid valve 240 is actuated to vacate pressure within the high pressure manifold 216 during the initial cranking of the motorized vehicle's engine, to be in conformance with the motorized vehicle's original pressure design parameters. Once the vehicle has started, the solenoid valve 240 would again be actuated to enable the fuel delivery routine as described above. While the primary function of the solenoid valve 240 is to reduce the build-up of pressure during a starting operation, the present invention also contemplates actuating the solenoid valve 240 in order to lower the opening and closing pressures of the nozzles 220 during low idle to reduce idling noise and the like.

As best seen in FIG. 6, the injection apparatus 200 utilizes the leak-off conduits 222, which are typically present in standard fuel delivery systems, to assist in the bootstrapping of pressurized fuel. The present invention may therefore be easily adapted to existing systems, as well as being more efficient. In certain circumstances, it may be necessary to adjust the tubing or conduit sizes, as well as the size of the nozzles 220 themselves, in order to make the injection apparatus 200 work as designed at all engine operating speeds and for all fuel delivery demands, and the present invention contemplates such modifications without departing from the broader aspects of the present invention, as discussed previously.

As can be seen from the foregoing disclosure and figures in combination, a controlled nozzle injection apparatus according to the present invention is advantageously provided with a plurality of beneficial operating attributes, including, but not limited to: enabling high starting pressure at the beginning of a fuel delivery cycle, maintaining higher end pressures at the conclusion of a fuel delivery cycle, reducing the exhaust of polluting contaminants and recycling excess pressurized fuel for later use. All of these attributes contribute to the efficient operation of an internal combustion engine and are especially beneficial in those situations where the retro-fitting of existing internal combustion engines are necessary in order to address ever increasingly stringent environmental concerns and regulations.

While the invention had been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A nozzle injection apparatus for use in internal combustion engines, said apparatus comprising:

a fuel pump for intermittently pressurizing fuel;

an injection conduit in fluid communication with said fuel pump, said injection conduit permitting said pressurized fuel to be communicated to a fuel injection nozzle;

a high pressure manifold in fluid communication with said fuel pump and said nozzle, wherein said high pressure manifold is oriented along said injection conduit between said fuel pump and said nozzle and accumulates said pressurized fuel which is residually left in said injection conduit between said intermittent pressurization of said fuel;

said high pressure manifold includes a first valve assembly for controlling the passage of said pressurized fuel from said fuel pump to said nozzle; and said high pressure manifold includes a second valve assembly for controlling the passage of said residual pressurized fuel from said injection conduit to said high pressure manifold.

2. The nozzle injection apparatus for use in internal combustion engines according to claim 1, further comprising:

a pressure relief valve in fluid communication with said high pressure manifold; and a fuel return conduit in fluid communication with said high pressure manifold and said pressure relief valve, wherein actuation of said pressure relief valve vacates said accumulated pressurized fuel from said high pressure manifold to said fuel pump.

3. The nozzle injection apparatus for use in internal combustion engines according to claim 2, wherein:

said pressure relief valve comprises a solenoid which is actuated during an initial cranking of said internal combustion engine.

4. The nozzle injection apparatus for use in internal combustion engines according to claim 1, wherein:

said first valve assembly comprises a ball valve assembly; and said second valve assembly comprises a spool valve assembly.

5. The nozzle injection apparatus for use in internal combustion engines according to claim 1, further comprising:

a leak-off conduit in fluid communication with said nozzle; and said high pressure manifold is in fluid communication with said leak-off conduit.

6. The nozzle injection apparatus for use in internal combustion engines according to claim 5, further comprising:

a dual valve assembly including a first valve for controlling the passage of said pressurized fuel from said fuel pump to said nozzle and a second valve for controlling the passage of said residual pressurized fuel from said injection conduit to said fuel pump; and said dual valve assembly is oriented along said injection conduit and between said fuel pump and said nozzle.

7. The nozzle injection apparatus for use in internal combustion engines according to claim 6, wherein:

said first valve is spring biased in a first direction;

said second valve is spring biased in a second direction which is in opposition to said first direction.

8. A method for controlling a nozzle injection apparatus of an internal combustion engine, said nozzle injection apparatus including a fuel pump for intermittently pressurizing fuel and an injection conduit for transporting streams of said intermittently pressurized fuel, said injection conduit being in fluid communication with said fuel pump and a fuel injection nozzle, said method comprising the steps of:

directing said pressurized fuel through said injection conduit to said fuel injection nozzle;

capturing said pressurized fuel which is residually left in said injection conduit between said intermittent pressurizations of said fuel; and applying said captured and pressurized fuel to subsequent streams of said intermittently pressurized fuel so as to raise a pressure of said subsequent streams when said subsequent streams are presented to said nozzle.

9. The method for controlling a nozzle injection apparatus according to claim 8, further comprising the steps of:

capturing said residual pressurized fuel in a high pressure manifold which is in fluid communication with said nozzle.

10. The method for controlling a nozzle injection apparatus according to claim 9, further comprising the steps of:

orienting said high pressure manifold to be in fluid communication with a leak-off conduit of said nozzle.

11. The method for controlling a nozzle injection apparatus according to claim 9, further comprising the steps of:

shunting a portion of said residual pressurized fuel captured in said high pressure manifold back to said fuel pump when a pressure in said high pressure manifold exceeds a predetermined pressure.

12. The method for controlling a nozzle injection apparatus according to claim 9, further comprising the steps of:

evacuating said residual pressurized fuel from said high pressure manifold back prior to initiating a start-up procedure for said internal combustion engine.

13. A method for controlling a nozzle injection apparatus of an internal combustion engine, said nozzle injection apparatus including a fuel pump for intermittently pressurizing fuel and an injection conduit for transporting streams of said intermittently pressurized fuel, said injection conduit being in fluid communication with said fuel pump and a fuel injection nozzle, said method comprising the steps of:

directing said pressurized fuel through said injection conduit to said fuel injection nozzle;

maintaining an elevated pressure within said injection conduit between said intermittent pressurizations of said fuel; and ensuring that said injection conduit is vacated of said elevated pressure prior to initiating a start-up procedure for said internal combustion engine.

14. The method for controlling a nozzle injection apparatus according to claim 13, further comprising the steps of:

maintaining said elevated pressure within said injection conduit during operation of said internal combustion engine.

15. The method for controlling a nozzle injection apparatus according to claim 13, further comprising the steps of:

vacating a portion of said elevated pressure from said injection conduit when said elevated pressure exceeds a predetermined pressure.

16. The method for controlling a nozzle injection apparatus according to claim 13, further comprising the steps of:

utilizing said pressurized fuel which is residually left in said injection conduit between said intermittent pressurizations of said fuel to raise a pressure within said injection conduit to said elevated pressure.

* * * * *